US006772613B2

(12) United States Patent
Webb et al.

(10) Patent No.: US 6,772,613 B2
(45) Date of Patent: Aug. 10, 2004

(54) LOCK SYSTEM FOR A HORIZONTAL LOCKING BOX

(75) Inventors: Freddie C. Webb, Algonquin, IL (US); Gerald Draffkom, Jr., Woodstock, IL (US)

(73) Assignee: Knaack Manufacturing Company, Crystal Lake, IL (US)

( * ) Notice: Subject to any disclaimer, the term of this patent is extended or adjusted under 35 U.S.C. 154(b) by 0 days.

(21) Appl. No.: 10/606,986

(22) Filed: Jun. 26, 2003

(65) Prior Publication Data

US 2003/0233856 A1 Dec. 25, 2003

Related U.S. Application Data

(63) Continuation of application No. 10/001,345, filed on Oct. 25, 2001, now abandoned.
(60) Provisional application No. 60/244,472, filed on Oct. 31, 2000.

(51) Int. Cl.[7] ..... B65D 55/14
(52) U.S. Cl. ..... 70/159; 70/164; 70/54; 70/63; 70/129; 292/148
(58) Field of Search ..... 70/159, 164, 54–56, 70/DIG. 56, 63, 129; 292/104, 205, 148, 324

(56) References Cited

U.S. PATENT DOCUMENTS

| | | | |
|---|---|---|---|
| 2,794,663 A | 6/1957 | Grodt et al. | |
| 3,334,933 A | 8/1967 | Ehlers | |
| 4,234,220 A | 11/1980 | Finch et al. | |
| 4,290,281 A | 9/1981 | Knaack et al. | |
| 4,307,904 A | 12/1981 | Daus | |
| 4,437,692 A | 3/1984 | Halopoff | |
| 4,613,175 A | 9/1986 | Nelson | |
| 4,630,750 A | 12/1986 | Hughes | |
| 4,643,469 A | 2/1987 | Johnston et al. | |
| 4,655,487 A | 4/1987 | Korn et al. | |
| 4,883,294 A | 11/1989 | Goodspeed | |
| 4,911,486 A | 3/1990 | Anderson | |
| 4,977,763 A | 12/1990 | Sewell | |
| 5,076,078 A | 12/1991 | Weger, Jr. | |
| 5,235,830 A | 8/1993 | Benge | |
| 5,308,126 A | 5/1994 | Weger, Jr. et al. | |
| 5,477,710 A | 12/1995 | Stefanutti | |
| 5,875,948 A | 3/1999 | Sadler | |
| 6,351,975 B1 | 3/2002 | Valdes | |
| 6,439,008 B1 | 8/2002 | Keil | |
| 6,494,064 B1 | 12/2002 | Pena | |
| 6,578,398 B2 * | 6/2003 | Behunin | 70/417 |

OTHER PUBLICATIONS

International Search Report from International Application No. PCT/US01/50422, dated Apr. 19, 2002.

* cited by examiner

*Primary Examiner*—John B. Walsh
(74) *Attorney, Agent, or Firm*—McDonnell Boehnen Hulbert & Berghoff LLP

(57) ABSTRACT

A lock system for a horizontal tool box wherein the latching mechanism for the lid may be operated from the proximal end of the toolbox and locking is achieved by means of a single padlock which is likewise located at the proximal end of the toolbox. An elongated latch rod is slidably disposed adjacent a front wall of either the body or lid components of the box. The padlock and the elongated latch rod are disposed such that the padlock body blocks the longitudinal movement of the proximal end of the latch rod and maintains the latch rod in the latched position when the body components are in the closed position and the padlock is locked, but the proximal end of the latch rod passes between the shackle and the padlock body to move the latch rod to the release position when the padlock is unlocked.

20 Claims, 6 Drawing Sheets

22
20
48
24
122
120
92
96
104
82
86
102
94
32
100
144
112
110
80
136
90
50
132
114
142
140
84
88
98
52
134
131
46
57
58
68
56
62
64
130
66
60
70
59
72

LOCK SYSTEM FOR A HORIZONTAL LOCKING BOX

FIELD OF THE INVENTION

The present invention relates generally to a lock system for a horizontal container, and more particularly to a lock system in which a padlock is located within the container so as to not be exposed to tampering.

BACKGROUND OF THE INVENTION

Containers, such as tool boxes and storage cabinets, which are used at construction job sites and similar locations for storing tools and materials, are typically protected from theft by means of padlocks. In many instances, due to the value of the tools or materials stored in such containers, it is additionally desirable to use containers having lock systems that shield the padlock so that the padlock will not be exposed to tampering, such as by attempts to cut the padlock shackle or pry the shackle from the padlock body U.S. Pat. No. 4,290,281 to Knaack et al., owned by the assignee of this application, describes and claims a lock system for a container in which a padlock is mounted on a support within the container such that only its key insertion surface is exposed for external access. In a disclosed embodiment of the lock system for a storage cabinet, the support is mounted on a vertical stile of the cabinet A slide member is mounted on the stile for movement, and has means for coupling to the doors of the cabinet and maintaining the doors in a closed position when the slide member is in a lowered position. Locking of the doors is achieved through cooperation of a tang, which is pivotally mounted on the underside of the slide member, and the shackle of the padlock which is captured by the support. The tang is positioned for insertion between the shackle and the body of the padlock when slide member is in its lowered position. When the padlock is locked, the body of the padlock pushes the tang toward the shackle so that a notch on the tang captures the shackle thereby preventing a slide member from being raised to unlatch the doors. To in order to allow the tang to disengage from the shackle when the padlock is unlocked, the tang is mounted such that it is normally urged by its own weight to an inclined position from the shackle.

While the embodiment of the lock system illustrated in the Knaack et al. patent is very effective for preventing padlock tampering, it can be somewhat cumbersome and time consuming to install, especially in the confined space of a tool chest or cabinet.

A lock system which addresses this installation problem of the Knaack et al. system is described in U.S. Pat. No. 5,076,078 to Weger, Jr. The Weger patent is also assigned to the assignee of this application. Like the Knaack et al. system, the lock system disclosed in this patent uses a slide member with a tang for engaging a shackle of a padlock. In some embodiments disclosed in this patent, the shackle of the padlock is captured on the support by means of an easily removable U-shaped bracket which has a pull-up ledge with coaxial openings for capturing the shackle.

Although the Weger system provides certain improvements over the Knaack et al. system, it is still not entirely satisfactory due to the use of a free hanging pin, the lock system has the significant limitation that it can only be used in containers that accommodate it in an upright position. Furthermore, the correct operation of the lock system requires reasonably precise alignment of the tang with respect to the shackle of the padlock. However, since the tang is designed to hang freely on the slide member, there is no means for positively controlling its position. Thus, if the cabinet is not level, the inclined position of the tang will be affected, and the notch on the tang may not be clear of the shackle when the padlock is unlocked. Similarly, friction in the pivotable support of the tang or between the tang and the shackle or the bracket may prevent the tang from returning to its normal inclined position when the padlock is unlocked, thereby hindering the operation of the lock system. Because the slide member normally stays in the lower position, the doors normally remain latched in the closed position even when the padlock is unlocked. Thus, every time a user attempts to open the door, he has to move the slide member up to unlatch the doors. Although this arrangement prevents accidental opening of the doors, some users may consider it somewhat inconvenient and would rather leave the doors unlatched.

Various locking systems have been proposed for horizontally disposed locking boxes having an upwardly opening cover, as opposed to vertical doors. In order to prevent would-be thieves from prying open the corners of such horizontal boxes, horizontal storage cabinets typically include locking mechanisms at both free corners of the cover opposite the hinge. Horizontal tool boxes marketed by the assignee of this application typically include two padlocks disposed at opposite ends of the box adjacent the locking mechanisms for the free corners of the cover. Using two such padlocks can be inconvenient for the user in that two keys must be maintained and the two padlocks separately actuated to unlock the box. Moreover, if the box is disposed in a truck bed, transverse the vehicle, the user must unlock the lock at one end of the box and then walk around to the opposite side of the truck and unlock the opposite lock. Similarly, when locking the box, the user must ensure that both locks are locked. Thus, locking, checking, and unlocking locks at either end of the box can be a time consuming process with the potential for user error.

An attempt to provide a horizontal tool box wherein the latching mechanisms at opposite ends of the cover may be operated from one end of the box, a locking system for a horizontal container is disclosed in U.S. Pat. No. 5,308,126 to Weger, Jr. et al. This patent is likewise assigned to the assignee of this application. The Weger '126 patent discloses a push button lock system having a push button lock mechanism disposed along opposite sides of the container. Depression of either of the push buttons engages and displaces a pivoting latch member to disengage the pivoting latch member from a rigid latch member extending from the lid, while locking the push button lock pivots the pivoting latch member into engagement with the rigid latch member. The push button locks along opposite faces are coupled together by a series of tie rods, a stirrup and brackets which provide movement of the pivoting latch member of one side by operation of the lock of the opposite side.

While the Weger '126 patent locking system includes a relatively large number of moving parts, which may be susceptible to damage which could potentially prevent proper operation of the locking mechanism. Moreover, the disclosed lock system does not utilize a padlock, which is typically considered desirable by users.

U.S. Pat. No. 5,235,830 to Benje discloses a horizontal tool box which utilizes a single padlock locking system. The Benje reference includes a horizontally extending elongated tubular conduit which is spring biased toward one end of the box. The conduit includes two openings within its other face which are disposed to receive two spring biased pivotable latches extending from the interior surface of the cover. A lateral bar coupled to the tubular conduit by manes of a wing extends outward from the tubular conduit in order to facilitate movement of a tubular conduct against the biasing spring to permit the cover to be opened. Should the adjacent padlock be in the locked position, the horizontal unlocking movement of the wing is not sufficient to commit the tubular conduit to release the downwardly extending latches. The Benje reference, however, presents numerous practical concerns about safety as well as operation. For example, the Benje reference includes numerous relatively fragile movable parts and couplings, including the biasing springs of the latches extending from the cover as well as the pivotable connection of the latches to the cover. Moreover, the mechanism is highly susceptible to failure in that the tubular conduit must be slid a sufficient distance to completely release the spring biased latches were a biased into engagement with the openings in the conduit. This is of particular concern in that the spring biased tubular conduit must be held against the force of the conduit biasing spring while the cover is opened. Accordingly, if the tubular conduit cannot be sufficiently moved, the cover will not unlatch the user will be unable to open the box, regardless of whether the padlock is in a locked position or not. Further, the lock is disposed in the center of the front of the box, extending into the storage area, and the latching mechanism is large and cumbersome, likewise extending into storage space. This being the case, the components are highly susceptible to damage from the user lifting items in and out of the box. Moreover, the mechanism occupies valuable storage space. While the Benje reference attempts to minimize this concern by housing the mechanism in an extension protruding from the front wall of the box, the effect is the same. Finally, the Benje reference proposes a tool box which includes a central cover area which is not movable relative to the tool box, the central cover area being flanked by two movable covers hinged thereto. Accordingly, the Benje reference proposes an arrangement which utilizes two padlocks on opposite sides of the vehicle, rather than a desirable single padlock system.

OBJECTS OF THE INVENTION

Accordingly, it is a primary object of the invention to provide an improved tamper resistant lock system for a horizontal tool box. It is a more particular object of the invention to provide a horizontal tool box which utilizes a single padlock and locking mechanism with multiple latching points, each of which is simultaneously operated from one end of the box.

It is another object of the invention to provide a locking mechanism which is resistant damaged to due normal movement of objects into and out of the tool box. More particularly, it is an object to provide a locking mechanism which provides minimal protrusion into the storage area.

It is a further object of the invention to provide a locking system for a horizontal tool box which is resistant to failure. A related object is to provide a locking system which utilizes a minimal number of sturdy components which are resistant to failure and damage during normal usage. It is also an object of the invention to provide a lock system for a horizontal tool box in which the locking and unlocking thereof are accomplished by means of components whose positions can be positively controlled to guarantee the reliable operation of the system.

It is another object of the invention to provide a lock system for a horizontal tool box that can be left in an unlatched position after the padlock is unlocked to facilitate repeated opening and closing of the box cover.

It is also an object of the invention to provide a lock system which may utilize different sized padlocks.

SUMMARY OF THE INVENTION

In accordance with the invention, a high security lock system which requires a single padlock and can be operated from a proximal end of a horizontal tool box is provided. The lock system includes an elongated latch rod which is supported in the first body component of the horizontal tool box for sliding lateral movement between a release position and a latched position. Flanges having bores are disposed generally at the proximal and distal ends of the toolbox and extend into the enclosed space of the toolbox from the second body component of the horizontal toolbox. When the toolbox is closed and the latch rod is in the latched position, the latch rod is engaged with the flanges. When the latch rod is in the release position, the latch rod is disengaged from the flanges. The latch rod may be slid laterally within the toolbox between the latched and release positions by means of a handle accessible from the outside of the toolbox substantially adjacent the proximal end of the box.

Significantly, the padlock is supported within the toolbox with the key insertion surface of the padlock likewise accessible from the proximal end of the toolbox. The latch rod is disposed relative to the padlock such that when the horizontal tool box is in the closed position and the latch rod is in the latched position, the padlock body blocks the longitudinal movement of the proximal end of the latch rod to prevent the latch rod from moving into the unlatched position. Conversely, when the padlock is in the unlatched position, the padlock body no longer blocks the lateral movement of the proximal end of the latch rod. As a result, a padlock engaging portion at the proximal end of the latch rod is free to advance between the legs of the padlock shackle so that the latch rod may move to the release position. In this way, the user may operate both the latch rod and the padlock from the proximal end of the toolbox.

According of other aspects of the invention, the locking mechanism provides only minimal interference with the use of the toolbox, and the toolbox may utilize different types of padlocks. More specifically, the elongated latch rod is disposed substantially adjacent a front wall of the toolbox with the latching portions being offset therefrom only enough to permit engagement with the flanges. Additionally, the padlock is supported within the tool box by a bracket which may be adjusted to dispose the padlock shackle at different positions in order to accommodate different types of padlock designs while ensuring proper operation of the locking mechanism. The system also preferably includes an anti-theft mechanism wherein a channel is provided about one or more of the openings which receive the proximal end of the latch rod and the latching portions so that the latch rod and latching portions cannot be readily bent to disengage them from the associated opening.

DETAILED DESCRIPTION OF THE INVENTION

Figure 1:
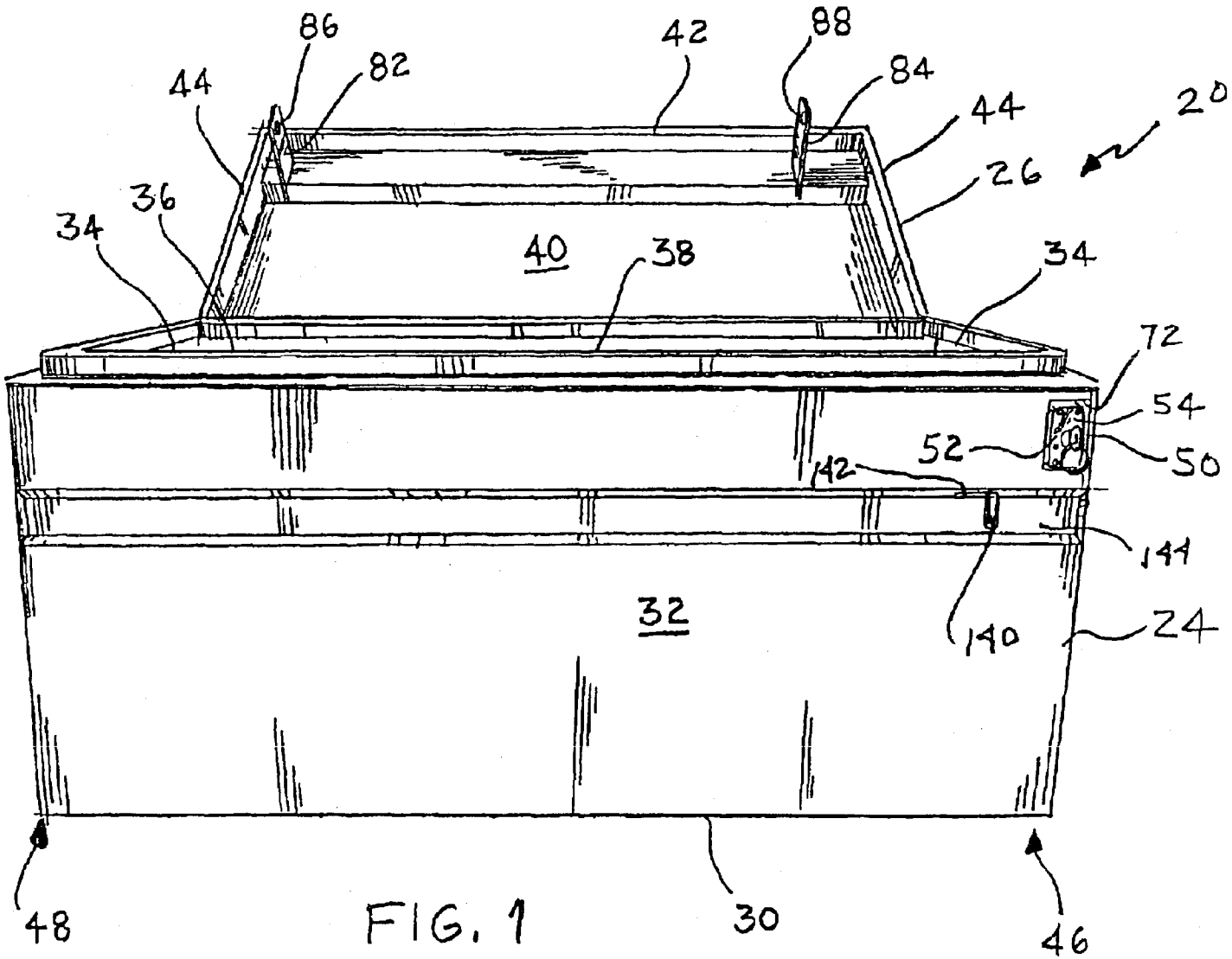
FIG. 1 is a front perspective view of a horizontal tool box incorporating a lock system according to teachings of the present invention.

Turning now to the drawings, FIG. 1 shows a horizontal storage cabinet or tool box 20, which is protected by an embodiment of the lock system of the present invention (identified generally as 22). The tool box 20 has a conventional look, with first and second body components 24, 26 identified as the body 24 and the lid 26 in the illustrated embodiment. While this description will refer to the body 24 and lid 26 as the first and second components, respectively, it will be appreciated by those skilled in the art that the location of various elements may be disposed along either the first or the second body components, i.e., the lid might alternately be identified as the first body component and the body identified as the second body component.

As illustrated, the body 24 comprises a bottom 30, and front, side, and back walls 32, 34, 36, which define an enclosed space 38. Similarly, the lid 26 includes a top portion 40, and may include front, side, and back walls 42, 44 (back wall not visible in position illustrated). The body 24 and lid 26 are hingably coupled along the back walls 36 such that they are movable between the open position illustrated in FIG. 1 and a closed position, further defining the enclosed space. The tool box 20 includes proximal and distal ends 46, 48. The horizontal tool box may be alternately constructed. For example, the horizontal tool box may be open along the top and a portion of the front wall, and may include a bi-fold lid which covers the top and the open portion of the front wall of the box, as is known by those of skill in the art.

In order to lock the tool box 20 to prevent theft when the box 20 is in its closed position, a conventional padlock 50 having a padlock body 52 with a key insertion surface 54, and a shackle 56 (FIGS. 2 and 3) is provided. The shackle 56 is generally U-shaped with a pair of legs 57, 58 and a bight section 59. As is conventional, the shackle 56 and padlock 52 are movable relative to one another between locked and unlocked positions. While the padlock 50 is illustrated as disposed along the right end of the box 20, it could alternately be disposed along the left end of the box 50, as would be desirable when the box 50 is to be utilized in the bed of a truck.

Figure 2:
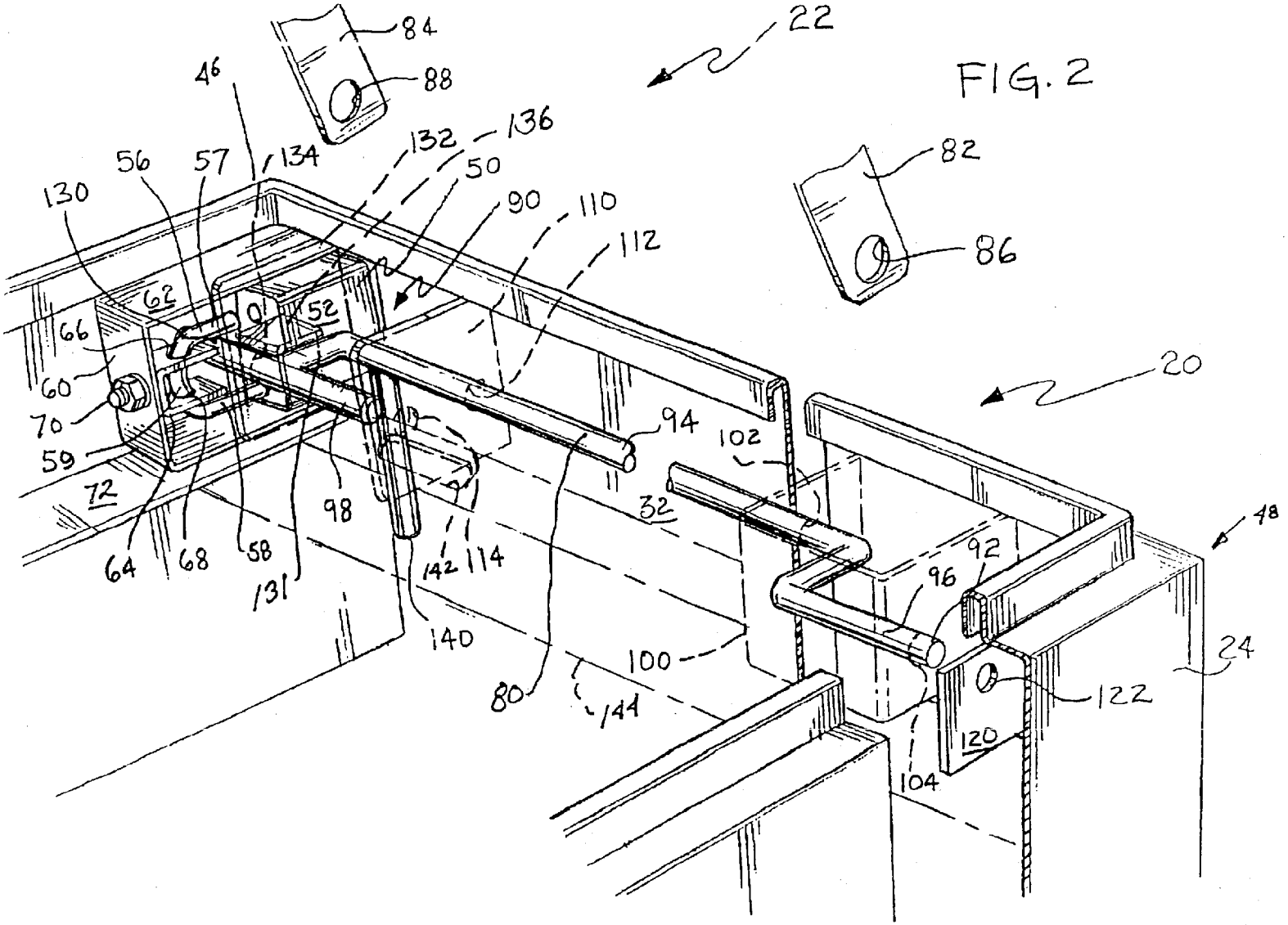
FIG. 2 is an inside fragmentary perspective view of the lock system of FIG. 1 shown in the unlocked position, certain components being shown in phantom to facilitate explanation and understanding.
Figure 3:
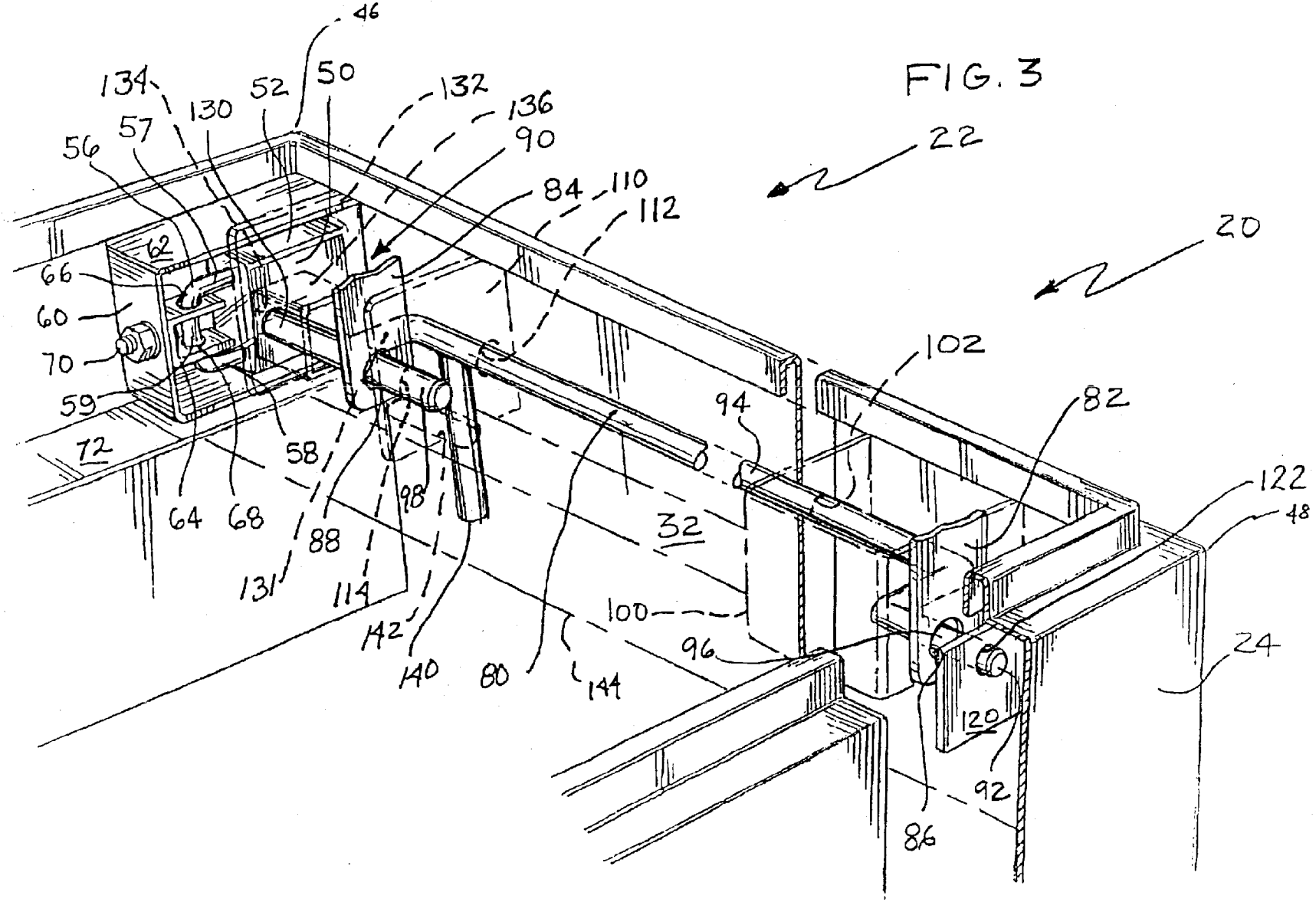
FIG. 3 is an inside perspective view of the lock system of FIG. 2 shown in the locked position, certain components being illustrated in phantom to facilitate understanding of the invention and explanation.

In order to secure the padlock 50 within the tool box 20, a support 60 is provided. The support 60 includes a box 62 and a bracket 64 for receiving the shackle of the padlock. The bracket 64 includes one or more openings 66, 68 through which the shackle 56 extends. The bracket 64 is preferably coupled to the box 62 by a fastener 70, in this case a nut and bolt. The box 62 is further secured, to the tool box 20 by any appropriate method, such as welding or the like. In order to permit the user to activate the padlock 50 while protecting the shackle 56 and its connection to the padlock body 52 from tampering, the support 60 disposes the padlock 50 adjacent an opening 72 (see FIGS. 1 and 4) in the wall of the tool box 20, in the illustrated embodiment, the wall 32 of the body 24, such that the key insertion surface 54 is accessible from the outside of the box 20. Inasmuch as the padlock body 52 is slidable within the support 60 relative to the secured shackle 56, the user may depress the padlock body 52 within the support 60 to lock the padlock 50 (as shown in FIG. 3), or actuate the key to unlock the padlock 50 and slide the padlock body 52 to the open position illustrated in FIG. 2.

According to the invention, the horizontal tool box 20 is provided with a lock system 22 which requires a single padlock 50 and which actuates latching mechanisms at both the proximal and distal ends 46, 48 of the box 20, both the padlock 50 and the latching mechanisms being actuable from the proximal end 46 of the box 20. The lock system 22 includes an elongated latch rod 80 which is supported in the first body component 24 for sliding lateral movement between a release position and a latched position wherein the latch rod 80 is disengaged or engaged, respectively, from flanges 82, 84 extending from the inside of the second body component 26 into the enclosed space of the horizontal tool box. As may best be seen in FIG. 1, the flanges 82, 84 are generally disposed at the distal and proximal ends 48, 46 of the tool box 20 and extend into the enclosed space defined by the tool box 20. In order to receive the latch rod 80, the first and second flanges 82, 84 each include a bore 86, 88, which extends therethrough.

The elongated latch rod 80 includes a proximal end 90 and a distal end 92. Significantly, the latch rod is disposed relative to the padlock support 50 such that when the horizontal tool box 20 is in the closed position and the latch rod 80 is in the latched position illustrated in FIG. 3, the padlock body 52 of a locked padlock 50 blocks the longitudinal movement of the proximal end 90 of the latch rod to prevent the latch rod from moving into the unlatched position. Conversely, when the padlock 50 is in the unlatched position as is illustrated in FIG. 2, the padlock body 52 no longer blocks the lateral movement of the proximal end 90 of the latch rod 80. More specifically, a padlock engaging portion 130 is provided at the proximal end 90 of the latch rod 80. When the padlock 50 is in the unlatched position shown in FIG. 2, the padlock engaging portion 130 is free to advance between the legs 57, 59 of the padlock shackle 56. Conversely, when the padlock 50 is in the locked position shown in FIG. 3, the padlock engaging portion 130 of the elongated latch rod 80 abuts the body 52 of the padlock 50 to prevent lateral movement of the latch rod 80. In this way, when the padlock 50 is unlocked, the latch rod 80 is free to be moved into the release position, as is illustrated in FIG. 2.

While the elongated latch rod 80 and the padlock 50 are both disposed within the first body component 24, or the body 24, it will be appreciated by those of skill in the art that the padlock 50 and latch rod 80 may be alternately disposed. For example, the latch rod 80 may be disposed within the first body component 24, while the padlock 50 may be coupled to the second body component 26, so long as the padlock 50 acts to limit the travel of the latch rod 80 when the horizontal tool box 20 is in the closed position.

Referring again to FIGS. 2 and 3, the latch rod 80 includes an elongated latch body portion 94 from which latching portions 96, 98 extend. Latching portion 96 is disposed at the distal end 92 of the latch rod 80 to engage the bore 86 in the first flange 86 extending from the inner surface of the lid 26, while the latching portion 98 at the proximal end 90 of the latch rod 80 is disposed to engage the bore 88 in the flange 84. As may be seen, both latching portions 96, 98 extend in the direction of the distal end 92 of the latch rod 80 such that laterally sliding the latch rod 80 in the distal direction substantially simultaneously engages the latching portion 96, 98 with the bores 86, 88 in the flanges 82, 84.

In order to slidingly support the latch rod 80 within the first body component 24, brackets 100 and 110 are provided. For ease of explanation, the brackets 100, 110 are illustrated in phantom in FIGS. 2 and 3. While the brackets may be of any appropriate form, bracket 100 has a generally U-shape and includes a bore 102 for supporting the latch body portion 94, and a bore 104 for supporting the first latching portion 96. In order to further ensure the security of the latching of the latching portion 96 to the first flange 82, an additional support bracket 120 which includes a bore 122 may be provided (shown in phantom). In this way, during use, the first latching portion 96 extends through the bore 104 of the first bracket 100, through the bore 86 of the first flange 82 extending from the second body component 26, and through the bore 122 of the bracket 120, brackets 100 and 120 both being secured to the first body component 24.

The second bracket 110 at the proximal end of the elongated latch rod 80 similarly includes a bore 112 for supporting the elongated latch body portion 94. It will be appreciated that bores 102 and 104 are offset from one another, and, accordingly, bores 102, 104 in conjunction with bore 112 in bracket 110 maintains the latch rod 80 in a steady, but sliding position within the first body component 24.

The second bracket 110 may additionally include a second bore 114 for receiving the distal end of the second latching portion 98. As may best be seen in FIG. 3, when latched, the second latching portion 98 extends through the bore 88 of the second flange 84 extending from the second body component 26, and through the bore 114 of the second bracket 110 secured to the first body component 24 to securely latch the first and second body components 24, 26.

Thus, the dual bracket design for coupling a first and second latching portions 96, 98 with the bores 86, 88 of the first and second flanges 82, 84 provides an arrangement which is highly resistant to tampering. More specifically, should a thief attempt to pry the second body component 26 from the first 24, the ends of the latching portions 96, 98 would be highly resistant to separation from the bores 86, 88 of the flanges 82, 84 because the very ends of the latching portions 96, 98 not only extend through the flange bores 82, 84, but further extend through the bores 122, 114 in brackets 100, 110.

It will be appreciated by those of skill in the art that latch rod 80 protrudes only minimally into the enclosed space defined by the first and second body components 24, 26. This is due to the particularized structure of the latch rod 80 in that the elongated latch body portion 94 is disposed substantially adjacent the front wall 32 of the first body component 24. The latching portions 96, 98 are then offset only as much as necessary to obtain the desired latching capabilities. Those of skill in the art will further appreciate that the elongated latch body portion 94 moves along a first longitudinal axis within the first body component 24. While the offset latching portions 96, 98 are slidably disposed along parallel longitudinal axes. The flanges 82, 84 extending from the second body component are thus disposed in perpendicular planes to the elongated latch rod 80.

In order to support the padlock 50 in position within the padlock support 60, and to support the padlock engaging portion 130 of the elongated latch rod 80, a bracket 132 (shown in phantom in FIGS. 2 and 3 for clarity of the drawing) is provided at the proximal end 46 of the horizontal tool box 20. As shown, the bracket 132 includes a bore 134 for receiving the padlock engaging portion 130 of the latch rod 80 and ensuring its proper positioning within the first 24 body component. To minimize opportunity for the padlock engaging portion 130 of the elongated latch rod 80 to disengage from the bore 134, the bracket 132 and a channel 136 is disposed about the bore 134 and protrudes from the surface of the bracket 132. The channel 136 extends a sufficient distance about the padlock engaging portion 130 to inhibit bending of the portion 130 such that its end would disengage from bore 134. The channel 136 preferred illustrated design, for example, is in the form of a "C-shaped" bracket, the top and bottom of which extend adjacent and subjacent the latch rod portion 130, a rearwardly extending portion 131 of the latch rod 80 being received in the open portion of the "C-shaped" bracket 136 when the latch rod 80 is in the proximal, unlatched position shown in FIG. 2. As a result, the latch rod portion 130 is resistant to disengaging from bore 134, even when an upward force is exerted on the latch rod 80 by the flange 84 as a would-be thief attempts to pry the tool box open. Similar brackets could be provided around the other bores through which portions of the latch rod 80 extend, e.g., bores 114 and 122.

Figure 4:
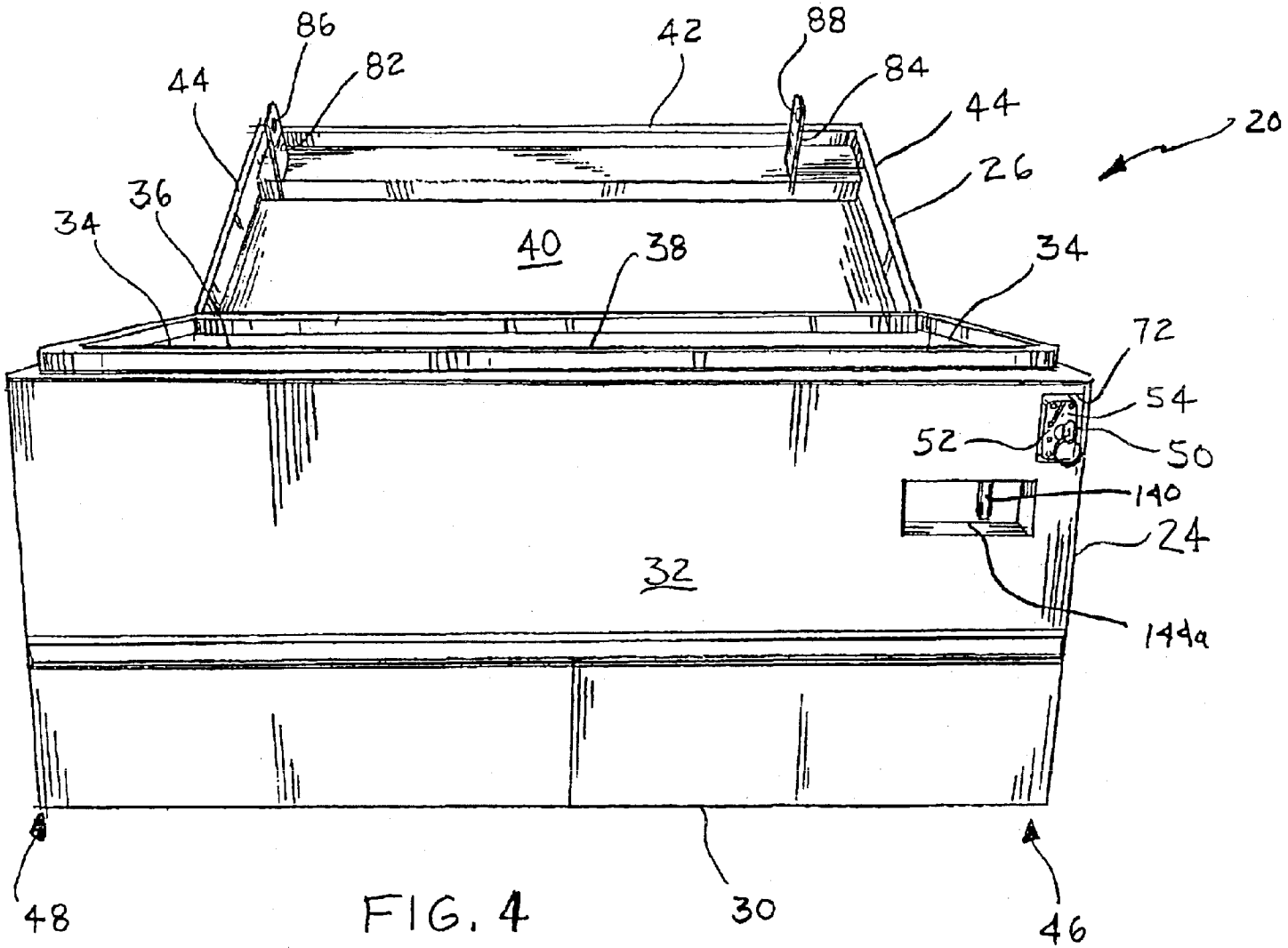
FIG. 4 is an alternate embodiment of the tool box of FIG. 1.

To facilitate lateral movement of the elongated latch rod 80 within the tool box 20, the latch rod 80 includes a handle 140 which is secured to the latch rod 80, and is accessible to the user from the outside of the horizontal tool box 20. To minimize opportunity for damage to the handle 140, the handle 140 preferably extends generally downward from the latch rod 80 and through an elongated slot 142 (shown in phantom in FIGS. 2 and 3 for clarity of the drawings) in the upper wall of a recessed portion 144 of the front wall 32. It will be appreciated that the recessed portion 144 presents an aesthetically pleasing, stylish appearance for the box. An alternate embodiment which includes a recessed box portion 144*a* is illustrated in FIG. 4. While presenting an alternate appearance, the embodiment of FIG. 4 operates identically to the embodiment of FIGS. 1–3. In use, the user may move the handle 140 laterally within the recessed portion 144 or recessed box 144*a* to slide the latch rod between the latched and unlatched positions. In keeping with an important aspect of the invention, the handle 140 and the padlock 50 are both disposed substantially adjacent the proximal end 46 of the horizontal tool box 20 whereby the user may latch and lock or unlatch and unlock the box from a single end thereof.

According to another feature of the invention, the padlock support 60 may be structured such that it can utilize more than one size or type of padlock. Referring now to FIGS. 5–8, there is illustrated a padlock support 160 which includes a box 162 that is formed of a stamped sheet metal wherein sides 162*a*, 162*b*, and end 162*c* portions extend from a back wall 162*d*.

Figure 5:
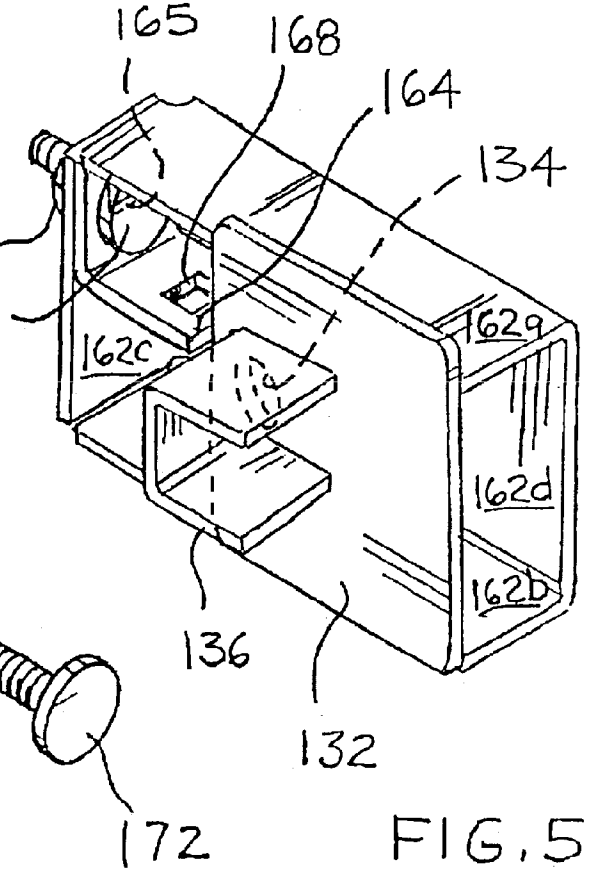
FIG. 5 is a perspective view of a shackle support bracket constructed in accordance with teachings of the invention, the shackle support bracket being adaptable to two different locks.
Figure 6:
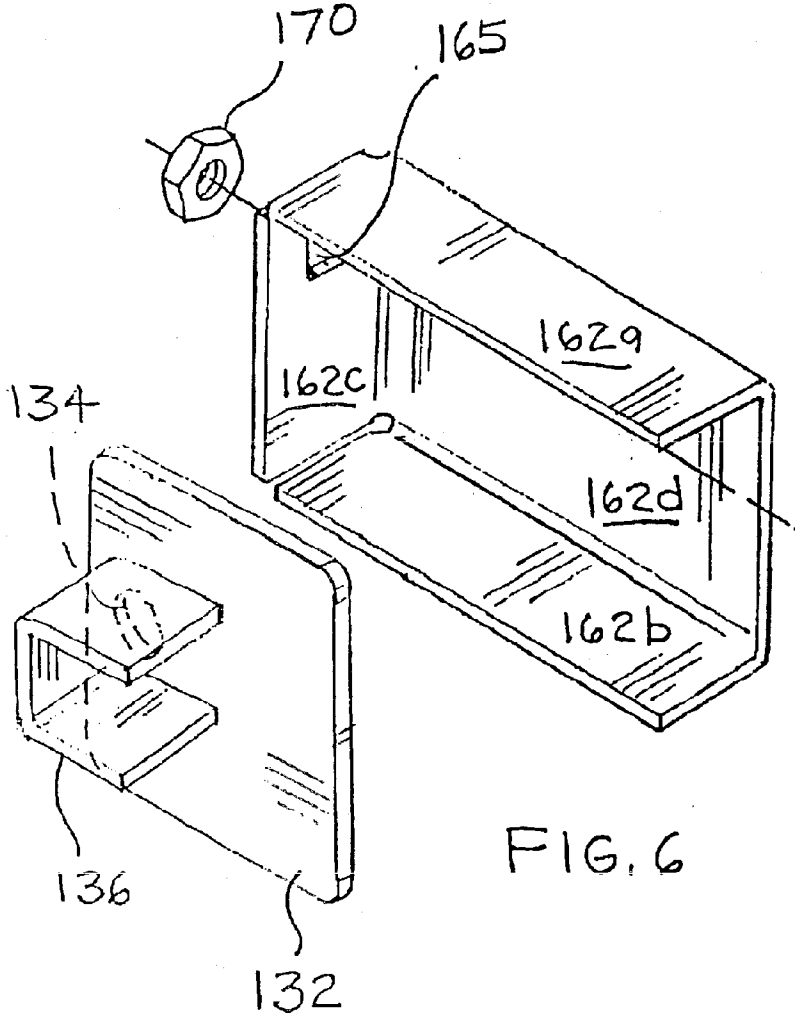
FIG. 6 is an exploded perspective view of the shackle support bracket of FIG. 5.
Figure 7:
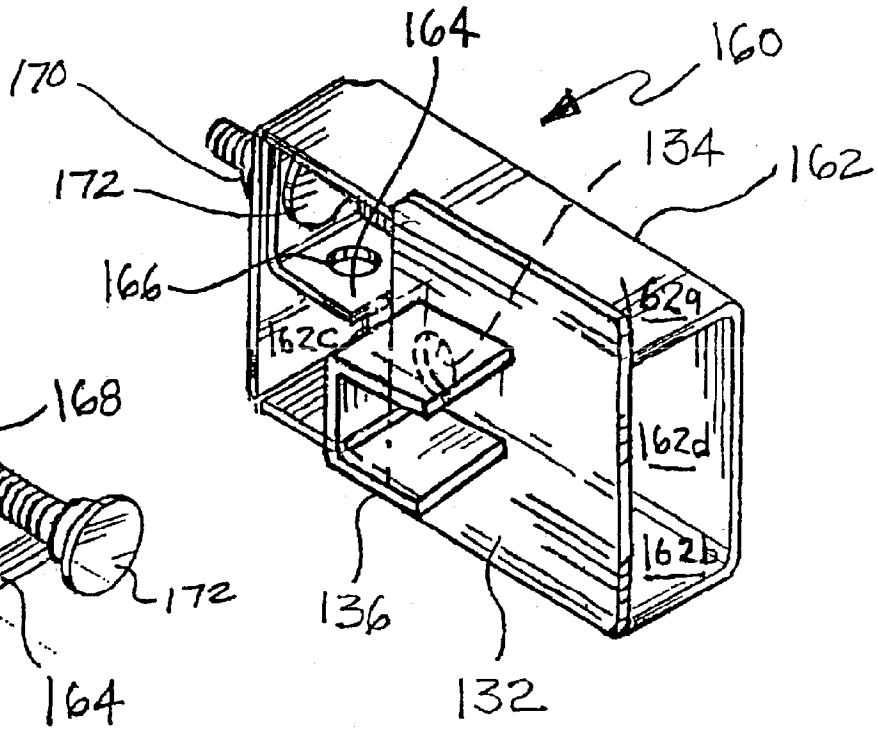
FIG. 7 is a perspective view of the shackle support bracket of FIG. 5 shown in a second configuration for accommodating a different size padlock.
Figure 8:
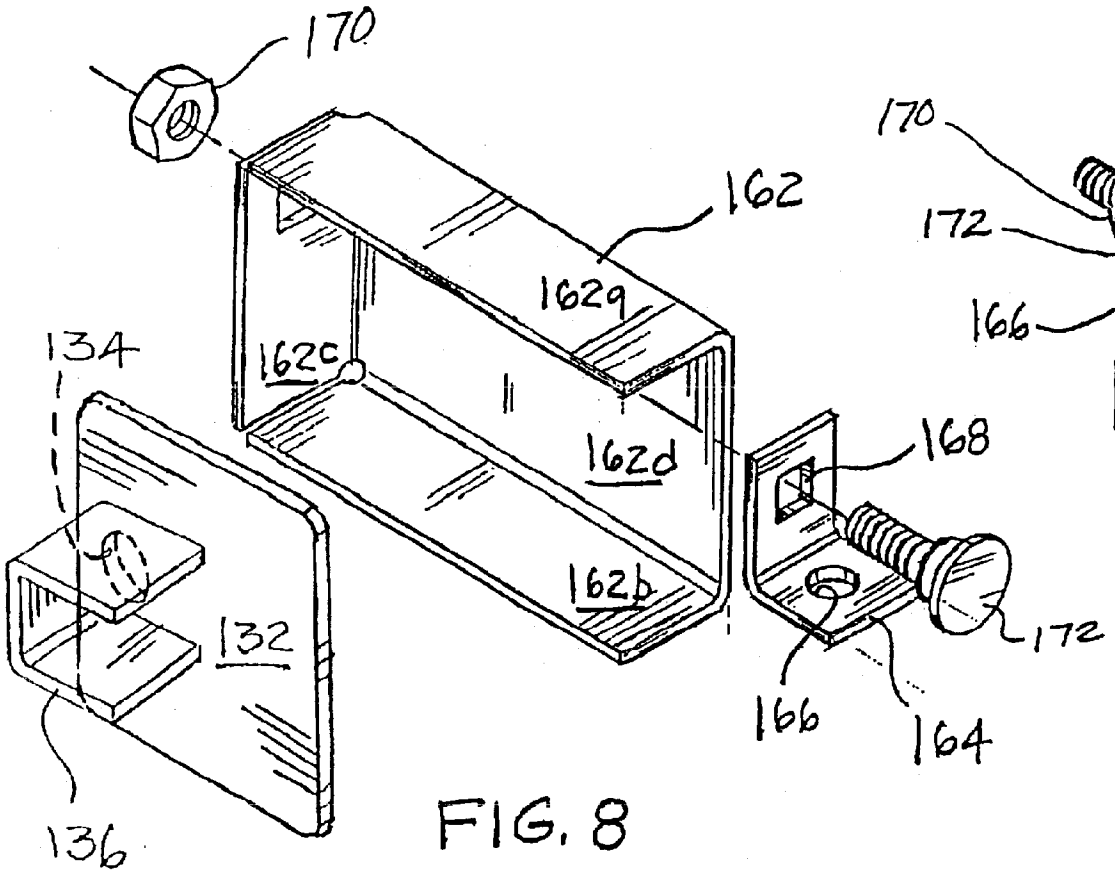
FIG. 8 is an exploded view of the shackle support bracket as illustrated in FIG. 7.

In order to permit the inventive padlock support 160 to effectively utilize different sizes of padlocks, the bracket 164 includes two separate openings 166, 168 which are alternately used to couple the bracket 164 to the support box 162 or to receive the shackle 56 of the padlock (see FIGS. 2–3). Significantly, the bracket 164 has an L-shape with the openings 166, 168 being disposed along opposite legs of the "L" at different distances from the apex. When coupled to the box 162 via a coupler, such as a nut and bolt 170, 172, the location of the openings 166, 168 then dictate location of the shackle 56, and accordingly, the padlock body 52. In order to facilitate proper attachment of the bracket 164 to the support box 162, wall 162*c* includes an opening 165. Thus, the bracket may be disposed as illustrated in FIGS. 5 and 6, or as illustrated in FIGS. 7 and 8 to provide alternate positioning of a padlock 50 within the support 160. Those of skill in the art will appreciate that this arrangement provides great versatility in the user's choice and use of a desired padlock 50.

It will be appreciated now that what has been provided is a significantly unproved padlock-protecting lock system for a horizontal tool box which is simple, robust, and reliable while the invention has been described in connection with certain embodiments, however, it will be understood that it is not intended to limit the invention to those particular embodiments. On the contrary, it is intended to cover all alternatives modifications, and equivalents included within the spirit and scope of the invention as defined by the appended claims.

What is claimed is:

1. A lock system for a horizontal tool box having first and second body, components, said body components being moveable relative to one another between open and closed positions, said body components defining an enclosed space in the closed position, said tool box having a proximal end and a distal end and utilizing a padlock having a shackle and a padlock body having a key insertion surface, said padlock being moveable between a locked position and an unlocked position, said lock system comprising:

a support for holding the padlock inside the tool box, said support being secured within the tool box and opening along an outer surface of the toolbox, said support including a bracket, the shackle being received by the bracket such that the bracket secures the shackle to the tool box and the shackle is substantially inaccessible from outside the tool box, said padlock body being slidably disposed within the support such that the key insertion surface of the padlock body is exposed for external access along the proximal end of the tool box, a first flange disposed at substantially the distal end of the box and a second flange disposed at substantially the proximal end of the box, said flanges each having a bore extending therethrough, the flanges being secured to and extending from the second body component, an elongated latch rod having a proximal end and a distal end, said latch rod being supported in the first body component for sliding lateral movement between a release position wherein the latch rod does not engage the flange bores, and a latched position wherein the distal end of the latch rod slidingly engages the first flange bore and the proximal end of the latch rod slidingly engages the second flange bore when the box is in the closed position, the latch rod being disposed relative to the support such that the padlock body blocks the longitudinal movement of the proximal end of the latch rod and maintains the latch rod in the latched position when the body components are in the closed position and the padlock is locked, and the proximal end of the latch rod passes between the shackle and the padlock body to move the latch rod to the release position when the padlock is unlocked, and a handle assessable from the outside of the box and disposed substantially along the proximal end of the box, said handle being coupled to the latch rod such that the handle may be moved to slide the latch rod laterally between the latched and release positions, whereby a user may lock and unlock the padlock and move the latch rod between the latched and release positions from the proximal end of the box.

2. The lock system for a horizontal tool box of claim 1 wherein the latch rod comprises an elongated latch body portion and latching portions offset from the latch body portion, said latching portions being disposed to engage the bores of the flanges.

3. The lock system for a horizontal tool box of claim 1 wherein the latch rod has a longitudinal axis and the flanges are disposed in a plane substantially perpendicular to the longitudinal axis.

4. The lock system for a horizontal tool box of claim 3 wherein the first body component further comprises a first bracket for slidingly supporting the distal end of the latch rod, and a second bracket having a bore for slidingly receiving the distal end of the latch rod, the brackets being disposed such that the first flange is disposed between the first and second brackets, the distal end of the latch rod extending adjacent the first bracket and the flange, and through the bore of the second bracket when in the latched position.

5. The lock system for a horizontal tool box of claim 2 wherein the latch body portion is disposed to move along a first longitudinal axis and at least one of the latch portions is disposed to move along a second longitudinal axis, said first and second longitudinal axes being disposed substantially parallel.

6. The lock system for a horizontal tool box of claim 5 wherein at least one said flange is disposed in a plane substantially perpendicular to the first longitudinal axis.

7. The lock system for a horizontal tool box of claim 6 wherein the first body component further comprises a first bracket for slidingly supporting the distal end of the latch rod, and a second bracket having a bore for slidingly receiving the distal end of the latch rod, the brackets being disposed such that the first flange is disposed between the first and second brackets, the distal end of the latch rod extending adjacent the first bracket and the flange, and through the bore of the second bracket when in the latched position.

8. The lock system for a horizontal tool box of claim 1 wherein the box further comprises a wall, at least a portion of the elongated latch rod being disposed substantially adjacent the wall such that any intrusion of the latch rod into the enclosed space is substantially minimized.

9. The lock system for a horizontal tool box of claim 2 wherein the box further comprises a wall and at least a portion of the elongated body portion is disposed substantially adjacent the wall such that any intrusion of the latch rod into the enclosed space is substantially minimized.

10. The lock system for a horizontal tool box of claim 1 further comprising a fastener for coupling the bracket to the support, the bracket including two openings therethrough, both said openings being operable to either receive the fastener to couple the bracket to the support or to receive the shackle, said openings being alternately disposable to secure the shackle at different positions in the support whereby the bracket may be used with at least two different types of padlocks.

11. The lock system for a horizontal tool box of claim 1 wherein the support further includes a wall extending along at least a portion of the padlock shackle and body, said support wall having an opening extending therethrough for receiving the proximal end of the latch rod, said support further including a channel protruding from said support wall disposed about at least a portion of said support opening and at least a portion of said proximal end of the latch rod.

12. The lock system for a horizontal tool box of claim 10 wherein the support further includes a wall extending along at least a portion of the padlock shackle and body, said support wall having an opening extending therethrough for receiving the proximal end of the latch rod, said support further including a channel protruding from said support wall disposed about at least a portion of said support opening and at least a portion of said proximal end of the latch rod.

13. A lock system for a tool box having first and second body components, said body components being moveable relative to one another between open and closed positions and defining an enclosed space in the closed position, said tool box utilizing a padlock having a shackle and a padlock body having a key insertion surface, said padlock being moveable between a locked position and an unlocked position, said lock system comprising:

a support for holding the padlock inside the tool box, said support being secured within the tool box and opening along an outer surface of the toolbox, said support including a bracket and a fastener for coupling the bracket to the support, the bracket including two openings therethrough, both said openings being operable to either receive the fastener to couple the bracket to the support or to receive the shackle such that the bracket secures the shackle to the tool box and the shackle is substantially inaccessible from outside the tool box, said openings being disposed to secure the shackle at different positions in the support whereby the bracket may be utilized with at least two different types of padlocks, the shackle being received by the bracket, said padlock body being slidably disposed within the support such that the key insertion surface of the padlock body is exposed for external access along the proximal end of the tool box, at least one flange extending from the second body component into the enclosed space, said flange having a bore extending therethrough, an elongated latch rod, said latch rod being supported in the first body component for sliding lateral movement between a release position wherein the latch rod does not engage the flange bore, and a latched position wherein the latch rod slidingly engages the flange bore when the box is in the closed position, the latch rod being disposed relative to the support such that the padlock body blocks the longitudinal movement of the proximal end of the latch rod and maintains the latch rod in the latched position when the body components are in the closed position and the padlock is locked, and the proximal end of the latch rod passes between the shackle and the padlock body to move the latch rod to the release position when the padlock is unlocked, and a handle assessable from the outside of the box, said handle being coupled to the latch rod such that the handle may be moved to slide the latch rod between the latched and release positions.

14. The lock system claimed in claim 13 wherein the bracket comprises two legs disposed at a substantially perpendicular angle and an apex, the openings of the bracket being differently sized whereby the shackle of the padlock will be disposed at different positions within the support.

15. The lock system claimed in claim 13 wherein the bracket comprises two legs disposed at a substantially perpendicular angle and an apex, the openings of the bracket being disposed at different distances from the apex whereby the shackle of the padlock will be disposed at different positions within the support.

16. The lock system claimed in claim 13 wherein the support further includes a wall extending along at least a portion of the padlock shackle and body, said support wall having an opening extending therethrough for receiving the proximal end of the latch rod, said support further including a channel protruding from said support wall disposed about at least a portion of said support opening and at least a portion of said proximal end of the latch rod.

17. A lock system for a tool box having a wall, said tool box further having first and second body components, said body components being moveable relative to one another between open and closed positions and defining an enclosed space in the closed position, said tool box utilizing a padlock having a shackle and a padlock body having a key insertion surface, said padlock being moveable between a locked position and an unlocked position, said lock system comprising:

a support for holding the padlock inside the tool box, said support being secured within the tool box and opening along an outer surface of the toolbox, said support including a bracket, the shackle being received by the bracket such that the bracket secures the shackle to the tool box and the shackle is substantially inaccessible from outside the tool box, said padlock body being slidably disposed within the support such that the key insertion surface of the padlock body is exposed for external access along the proximal end of the tool box, at least one flange extending from the second body component into the enclosed space, said flange having a bore extending therethrough, an elongated latch rod comprising an elongated latch body portion and at least one latching portion offset from the latch body portion, said elongated latch body being disposed substantially adjacent said tool box wall whereby the enclosed space is substantially unobstructed by the elongated latch body portion, said latching portions being disposed to engage the bore of the at least one flange, said latch rod being supported in the first body component for sliding lateral movement between a release position wherein the at least one latching portion does not engage the flange bore, and a latched position wherein the at least one latching portion slidingly engages the flange bore when the box is in the closed position, the latch rod being disposed relative to the support such that the padlock body blocks the longitudinal movement of the latch rod and maintains the at least one latching portion in the latched position when the body components are in the closed position and the padlock is locked, and the latch rod passes between the shackle and the padlock body to move the at least one latching portion to the release position when the padlock is unlocked, and a handle assessable from the outside of the box, said handle being coupled to the latch rod such that the handle may be moved to slide the latch rod between the latched and release positions, whereby a user may lock and unlock the padlock and move the latch rod between the latched and release positions.

18. The lock system for a tool box of claim 15 wherein the latch body portion is disposed to move along a first longitudinal axis and at least one of the latch body portions is disposed to move along a second longitudinal axis, said first and second longitudinal axes being disposed substantially parallel.

19. The lock system for a tool box of claim 15 wherein the latch rod has proximal and distal ends and the support is disposed at the proximal end of the latch rod when the tool box is in the closed position such that the padlock body blocks the longitudinal movement of the proximal end of the latch rod and maintains the at least one latching portion in the latched position when the body components are in the closed position and the padlock is locked.

20. The lock system for a tool box of claim 17 wherein the support further includes a wall extending along at least a portion of the padlock shackle and body, said support wall having an opening extending therethrough for receiving the proximal end of the latch rod, said support further including a channel protruding from said support wall disposed about at least a portion of said support opening and at least a portion of said proximal end of the latch rod.

* * * * *